US007737375B2

(12) United States Patent
Katori et al.

(10) Patent No.: US 7,737,375 B2
(45) Date of Patent: Jun. 15, 2010

(54) KEY SHEET

(75) Inventors: Masaya Katori, Tokyo (JP); Toshikazu Yoshioka, Tokyo (JP); Tedi Kunthady, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 11/785,462

(22) Filed: Apr. 18, 2007

(65) Prior Publication Data

US 2007/0246342 A1 Oct. 25, 2007

(30) Foreign Application Priority Data

Apr. 20, 2006 (JP) ..... 2006-117236

(51) Int. Cl.
*H01H 9/26* (2006.01)
*H01H 13/72* (2006.01)
*H01H 13/76* (2006.01)

(52) U.S. Cl. ..... 200/5 A; 200/512

(58) Field of Classification Search ..... 200/5 A
See application file for complete search history.

(56) References Cited

U.S. PATENT DOCUMENTS

| | | | | |
|---|---|---|---|---|
| 4,258,096 | A * | 3/1981 | LaMarche | 428/209 |
| 6,023,033 | A * | 2/2000 | Yagi et al. | 200/512 |
| 6,911,608 | B2 * | 6/2005 | Levy | 200/5 A |
| 7,070,349 | B2 * | 7/2006 | Dombrowski et al. | 400/490 |
| 7,119,296 | B1 * | 10/2006 | Liu et al. | 200/341 |
| 7,345,250 | B2 * | 3/2008 | Hakunti et al. | 200/5 A |
| 2002/0066660 | A1 * | 6/2002 | Ardrey et al. | 200/314 |
| 2005/0281605 | A1 | 12/2005 | Dombrowski et al. | |
| 2007/0235296 | A1 * | 10/2007 | Yoshioka et al. | 200/5 A |

FOREIGN PATENT DOCUMENTS

| | | |
|---|---|---|
| EP | 1587284 | 10/2005 |
| JP | 08-007698 A | 1/1996 |
| JP | 2000-200523 A | 7/2000 |
| JP | 2000-268674 A | 9/2000 |
| JP | 2001-283670 A | 10/2001 |

(Continued)

OTHER PUBLICATIONS

Office Action from Japan Patent Office for JP 2006-117236 dated Feb. 18, 2008, (Japanese Only).

(Continued)

*Primary Examiner*—Michael A Friedhofer
*Assistant Examiner*—Lheiren Mae A Caroc
(74) *Attorney, Agent, or Firm*—Cermak Nakajima LLP; Tomoko Nakajima

(57) ABSTRACT

Disclosed is a key sheet helping to solve problems caused by a rubber-like elastic material filling dividing grooves. A key sheet is provided with protrusions swelling from the back surface of an operation plate toward dividing grooves. The protrusions, which are formed by a film sheet formed of a thermoplastic resin, can prevent the problems when the rubber-like elastic material filling the dividing grooves are exposed, that is, separation or severance of the rubber-like elastic material. Further, nails or fingertips are not easily allowed to enter the dividing grooves of the operation plate. The protrusions in the grooves formed by the film sheet are not easily worn out through repeated depressing operation, thus realizing a thin and safe key sheet.

12 Claims, 7 Drawing Sheets

FOREIGN PATENT DOCUMENTS

| | | | |
|---|---|---|---|
| JP | 2004-071258 | A | 3/2004 |
| JP | 2004-227867 | A | 8/2004 |
| JP | 2004-311127 | A | 11/2004 |
| JP | 2004-362891 | A | 12/2004 |
| JP | 2005-108802 | A | 4/2005 |
| JP | 2006-156333 | | 6/2006 |
| JP | 2006-209989 | A | 8/2006 |
| JP | 2007-115633 | A | 5/2007 |
| JP | 2007-234450 | A | 9/2007 |
| WO | WO-2006/007220 | A1 | 1/2006 |

OTHER PUBLICATIONS

Search Report for European Patent App. No. 07007029.7 (Mar. 24, 2009).

* cited by examiner

KEY SHEET

BACKGROUND OF THE INVENTION

1. Field of the Invention

The present invention relates to a pushbutton switch key sheet for use in an operating portion of an apparatus such as a mobile phone, a PDA, a car navigation apparatus, or a car audio apparatus.

2. Related Background Art

Electronic/electric apparatuses for personal use have been reduced in size and thickness. Further, they have come to be endowed with various additional functions for enhancement in convenience for the user. However, for the better commercial value, in addition to the abundance in functions, it is important for this kind of product to have a unique and novel design. With regard to the mobile phone and the like, there is a tough competition for a design of a pushbutton switch key sheet forming a surface portion.

In a conventional example of such a pushbutton switch key sheet, a single operation plate having a plurality of depressing operation portions is exposed through an operational opening of a casing having no frame. Despite the absence of a frame, this key sheet does not suffer distortion or deflection. However, since the depressing operation portions are separated from each other by dividing grooves formed in the operation plate, nails or fingertips may get deep into the dividing grooves of the frame, and the nails or the fingertips may be injured by edges of the dividing grooves. To avoid this problem, the present applicant has proposed filling the dividing grooves with a rubber-like elastic material in JP 2006-156333 A (the specification of Japanese Patent Application No. 2005-133414).

However, the rubber-like elastic material filling the dividing grooves is subject to wear; as depressing operation is repeated, the rubber-like elastic material is gradually worn out by the fingertips, and there is a fear of the dividing grooves becoming gradually deeper. Then, nails or fingertips are allowed to enter the dividing grooves to suffer injury by edges of the dividing grooves. To prevent wear of the rubber-like elastic material filling the dividing grooves, a method is available according to which the operating surface of the operation plate is covered with a resin film. However, covering the operating surface with a resin film will lead to a kind of operational connection between adjacent depressing operation portions, and make it rather difficult to recognize the division between the depressing operation portions by the touch of the fingertips, resulting in erroneous input.

SUMMARY OF THE INVENTION

The present invention has been made in view of the above-mentioned problems in the prior art. It is accordingly an object of the present invention to solve the problems caused by the rubber-like elastic material filling the dividing grooves.

To achieve the above-mentioned object, the present invention is constructed as described below. That is, the present invention provides a key sheet including: an operation plate provided with a dividing groove defining a depressing operation member capable of displacement through depression; and a film sheet provided on a back surface which is on the opposite side of an operating surface of the operation plate, in which the film sheet is provided with a protrusion swelling from the back surface of the operation plate toward the dividing groove.

In the present invention, there is provided a protrusion formed by causing the film sheet to swell from the back surface of the operation plate toward the dividing groove. As compared with the rubber-like elastic material, the film sheet has higher wear resistance, so there is no fear of the protrusion which is formed of a resin, being gradually worn out through friction. Thus, it is possible to prevent the dividing groove from becoming gradually deeper as a result of the in-groove protrusion formed of a rubber-like elastic material being worn out through repeated depressing operation. Further, it is possible to prevent a nail or a fingertip from getting deep into the dividing groove to suffer injury from edges of the dividing groove.

In the key sheet of the present invention, the protrusion protrudes from the operating surface of the operation plate, so it is possible to ascertain the position of the dividing groove from the protruding configuration, and to easily identify the depressing operation member region by the touch. Thus, it is possible to prevent erroneous input. Further, it is possible to eliminate intrusion of a nail or a fingertip into the dividing groove.

In the key sheet of the present invention, it is possible to provide a gap between the protrusion and a side surface of the dividing groove. That is, the protrusion and the depressing operation member are spaced apart from each other, so it is possible to diminish the deformation of the protrusion when the depressing operation member is depressed. Thus, the load leading to deformation of the protrusion is reduced, making it possible to reduce the depression load to be applied to the depressing operation member.

In the key sheet of the present invention, the interior of the protrusion may be occupied by a solid portion formed of a rubber-like elastic material. Since the interior of the protrusion is occupied by a solid portion formed of a rubber-like elastic material, even if the protrusion is depressed with a fingertip at the time of depressing operation, the solid portion resists from within the protrusion, making it possible to prevent the protrusion from being dented.

In the key sheet of the present invention, a base sheet formed of a rubber-like elastic material may be provided on the back surface of the film sheet. Due to the provision of the film sheet formed of a rubber-like elastic material on the back surface of the film sheet, it is possible to endow the base sheet with a restoring force to be exerted when the depressing operation member is depressed. Further, the base sheet and the solid portion filling the interior of the protrusion are both formed of a rubber-like elastic material, so it is possible to form the base sheet and the solid portion simultaneously. Thus, the production of the key sheet is facilitated, and the integration of the base sheet with the operation plate can be easily realized.

In the key sheet of the present invention having the base sheet, the base sheet may be provided with a recess between adjacent depressing operation members. Due to the provision of the recess at a portion of the base sheet between adjacent depressing operation members, it is possible to form the portion of the base sheet between the depressing operation portions as a thin-walled portion. Thus, when the depressing operation member is depressed, the base sheet can easily undergo deformation, making it possible to diminish the depression load to be applied to the depressing operation member.

In the key sheet of the present invention, it is possible to form the dividing groove in a loop-like configuration and to provide a depression operating member defined by the loop-like dividing groove. Due to the provision of the depressing operation member separate from the operation plate, it is possible to realize a key sheet of a unique and novel design. Further, the depression load causing deformation of the protrusion situated in the dividing groove is smaller than the depression load causing the operation plate to bend, so, as compared with another depressing operation member surrounded by the dividing groove on, for example, three sides, the depression load to be applied to the depressing operation member defined by the oop-like dividing groove can be made smaller.

In the key sheet of the present invention, an adhesion layer may be provided between the operation plate and the film sheet. With this construction, the operation plate and the film sheet can be firmly bonded together, and it is possible to prevent separation between the operation plate and the film sheet even when the depressing operation is repeatedly conducted.

According to the present invention, it is possible to provide a key sheet which involves no problems due to the rubber-like elastic material filling the dividing grooves, for example, separation or severance of the rubber-like elastic material. Accordingly, it is possible to realize a thin and safe key sheet.

The above description of the present invention should not be construed restrictively; the advantages, features, and uses of the present invention will become more apparent from the following description given with reference to the accompanying drawings. Further, it should be understood that all appropriate modifications made without departing from the gist of the present invention are to be covered by the scope of the present invention.

DESCRIPTION OF THE PREFERRED EMBODIMENTS

Figure 1:
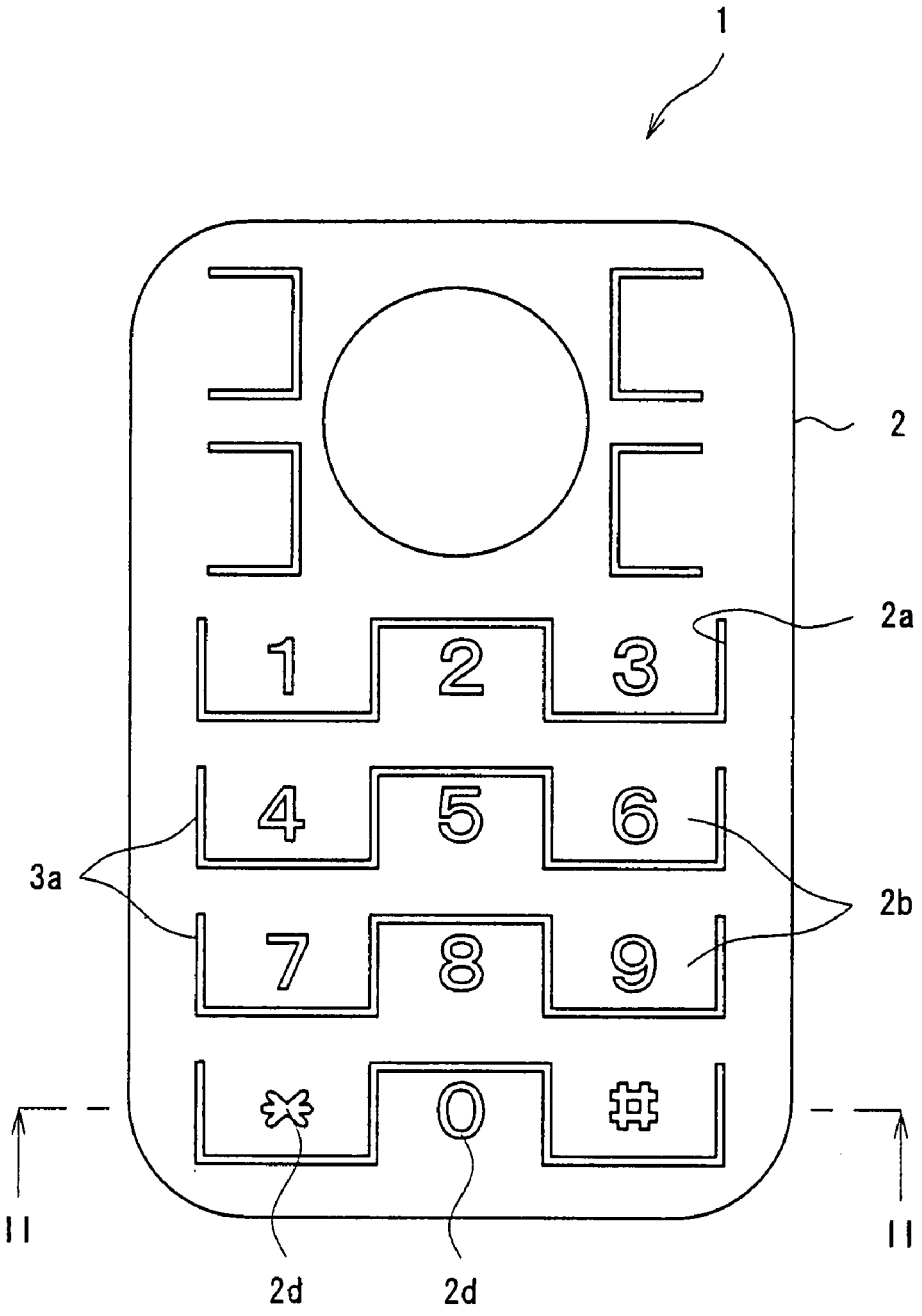
FIG. 1 is a plan view of a key sheet according to a first embodiment of the present invention.

In the following, embodiments of the present invention will be described with reference to the drawings. In the drawings, the reference symbols indicate portions and components of the embodiments. The components common to the following embodiments are indicated by the same reference symbols, and a redundant description thereof will be omitted. A redundant description of the same manufacturing methods and the same effects will also be omitted.

Figure 2:
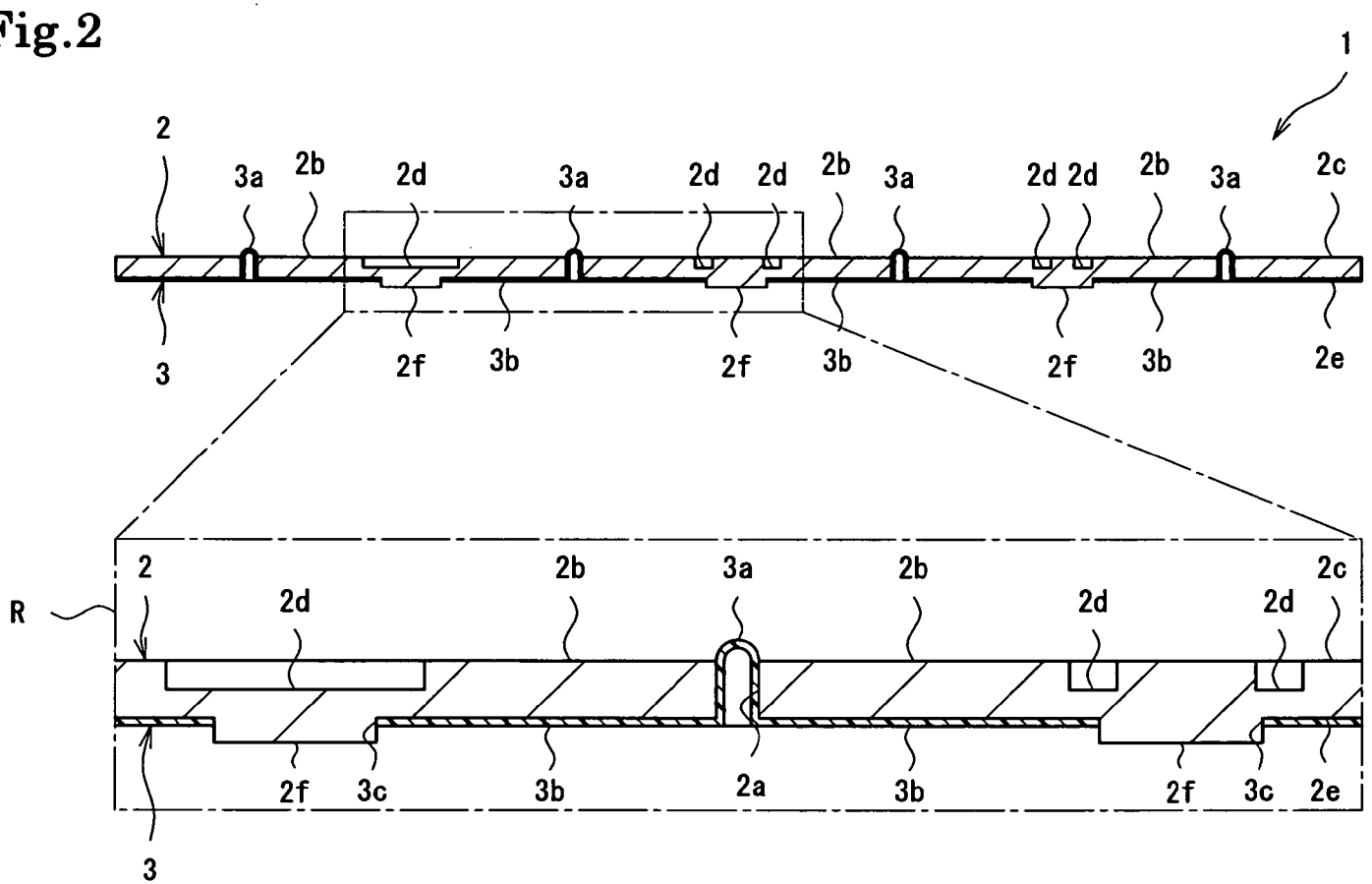
FIG. 2 is a sectional view taken along the line II-II of FIG. 1.

First Embodiment (FIGS. 1 and 2): As shown in FIGS. 1 and 2, a key sheet (1) according to a first embodiment is equipped with an operation plate (2) and a film sheet (3).

The operation plate (2) is formed of a single plate, which is provided, in a square-wave-like fashion, with dividing grooves (2*a*) formed as through-holes extending in the thickness direction. The tongue-shaped portions defined by the dividing grooves (2*a*) constitute depressing operation members (2*b*). At the respective centers of surfaces (2*c*) constituting the operating surfaces of the depressing operation members (2*b*), there are formed display portions (2*d*) as bottomed recesses representing characters, numbers, symbols, figures, etc. For example, in FIG. 1, the depressing operation member (2*b*) provided with the display portion (2*d*) representing the symbol "*" is defined by the dividing groove (2*a*) so as to be directed downward, and the depressing operation member (2*b*) provided with the display portion (2*d*) representing the number "0" is defined by the dividing groove (2*a*) so as to be directed upward. At the center of the back surface (2*e*) of each depressing operation member (2*b*), there is provided a pusher portion (2*f*) for depressing a contact switch (not shown).

The film sheet (3) is formed of a single sheet, and is fixed to the back surface (2*e*) of the operation plate (2) by means of an adhesion layer (not shown). The film sheet (3) has protrusions (3*a*) swelling through the dividing grooves (2*a*) of the operation plate (2) from the back surface (2*e*) side to the front surface (2*c*) side, with the tips of the protrusions (3*a*) protruding from the front surface (2*c*) of the operation plate (2). Further, the film sheet (3) has through-holes (3*c*) at positions corresponding to the respective centers of the depressing operation members (2*b*), and the pushers (2*f*) protruding from the back surface (2*c*) of the operation plate (2) fill the through-holes (3*c*).

Here, the materials of the components of the key sheet (1) will be described.

The operation plate (2) may be formed of a material of high rigidity. The material of high rigidity may be a hard resin, examples of which include a polycarbonate resin, a polyester resin, an acrylic resin, and an ABS resin. Apart from hard resins, examples of the material to be used include metals such as stainless steel, aluminum, chromium, gold, silver, copper, nickel, and tin. The thickness of the operation plate (2) may range from 50 μm to 2000 μm.

As the material of the film sheet (3), it is possible to use a material such as a resin film formed of a thermoplastic resin endowed with both flexibility and wear resistance and allowing formation in a protruding configuration. Examples of the resin to be used include a polyolefin type resin, a polyester type resin, a polyurethane type resin, and a polyamide type resin. When the thickness of the film sheet (3) ranges from 10 μm to 200 μm, it is possible to form the protrusions without involving breakage.

Next, an example of the method of manufacturing the key sheet (1) of this embodiment will be described.

First, the operation plate (2) made of a hard resin is formed by injection molding. At this time, the dividing grooves (2*a*) composed of through-holes extending in the thickness direction and the display portions (2*d*) in the form of bottomed recesses are formed by the cavity of the injection molding mold. An adhesion layer formed of a hot-melt adhesive is applied to the back surface (2*e*) of the operation plate (2).

Next, the operation plate (2) is inserted into the mold for molding the film sheet (3) such that the front surface (2*c*) thereof is held in contact with the mold surface, and then the film sheet (3) with the through-holes (3*c*) formed therein is placed on the back surface (2*e*) of the operation plate (2) before closing the mold to perform heating emboss molding on the film sheet (3). At this time, the protrusions (3*a*) are formed in the film sheet (3) through expansion by protrusions in the mold, and the back surface (2*e*) of the operation plate (2) and the film sheet (3) are fixed to each other. Finally, the outer edge of the film sheet (3) is cut off together with the outer edge of the operation plate (2), whereby the key sheet (1) is obtained.

Next, the effects of the key sheet (1) of this embodiment will be described.

In the key sheet (1) of the first embodiment, it is possible to prevent occurrence of problems involved in the case in which the rubber-like elastic material filling the dividing grooves (2*a*) is exposed, that is, separation and severance of the rubber-like elastic material. Further, nails and fingertips are not easily allowed to enter the dividing grooves (2*a*) of the operation plate (2). The protrusions (3*a*) formed by the film sheet (3) and protruding through the grooves are not easily worn out by repeated depressing operation, thus realizing a thin and safe key sheet (1).

Since the protrusions (3*a*) are formed by the film sheet (3), which is an integral unit, the handling of the film sheet at the time of manufacturing is easy, and the integration of the film sheet (3) with the operation plate (2) is facilitated.

Since the tip portions of the protrusions (3*a*) protrude from the front surface (2*c*) of the operation plate (2), it is possible to ascertain the positions of the dividing grooves (2*a*) by virtue of the protrusions (3*a*), making it possible to easily identify the regions of the depressing operation members (2*b*) by the touch with the fingertips. Thus, it is possible to prevent erroneous input.

Since the back surface (2*e*) of the operation plate (2) and the film sheet (3) are fixed to each other by means of an adhesion layer, it is possible to prevent separation of the operation plate (2) and the film (3) from each other even when depressing operation is repeatedly conducted. On the other hand, since the side surfaces of the dividing grooves (2*a*) of the operation plate (2) and the protrusions (3*a*) of the film sheet (3) are not fixed to each other by the adhesion layer, it is possible to deform the protrusions (3*a*) as a whole at the time of depressing operation. Instead, it is also possible to fix the side surfaces of the dividing grooves (2*a*) and the protrusions (3*a*) of the film sheet (3) to each other by applying hot-melt adhesive to the dividing grooves (2*a*) of the operation plate (2). In this case, the fixed portions of the protrusions (3*a*) are not deformed at the time of depressing operation, and solely the tip portions of the protrusions (3*a*) are deformed, so the depression load is increased.

Figure 3:
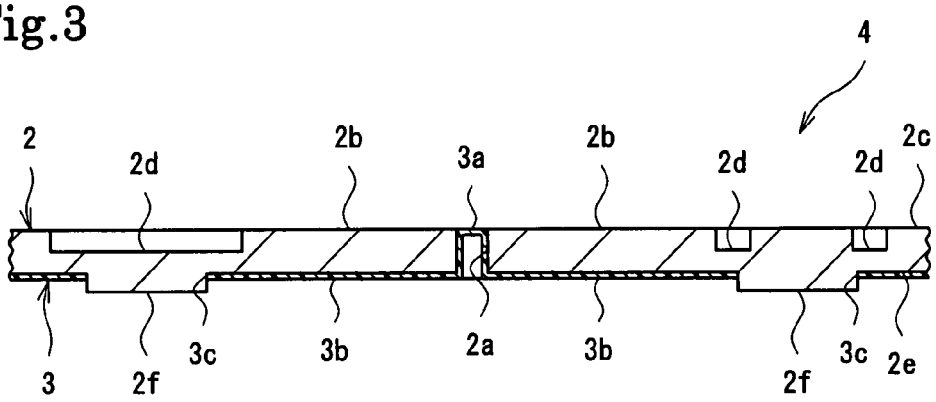
FIG. 3 is a sectional view, corresponding to region R of FIG. 2, of a first modification of the key sheet of the first embodiment.

First Modification of the First Embodiment (FIG. 3): FIG. 3 shows a key sheet (4) according to a first modification of the first embodiment. While in the key sheet (1) of the first embodiment the tip portions of the protrusions (3*a*) protrude from the front surface (2*c*) of the operation plate (2), in the key sheet (4) of the first modification, the tips of the protrusions (3*a*) and the front surface (2*c*) of the operation plate (2) are flush with each other. With this construction, no force in the shearing direction is applied to the protrusions (3*a*) by fingertips or the like, making the protrusions (3*a*) less subject to deformation by fingertips or the like.

Figure 4:
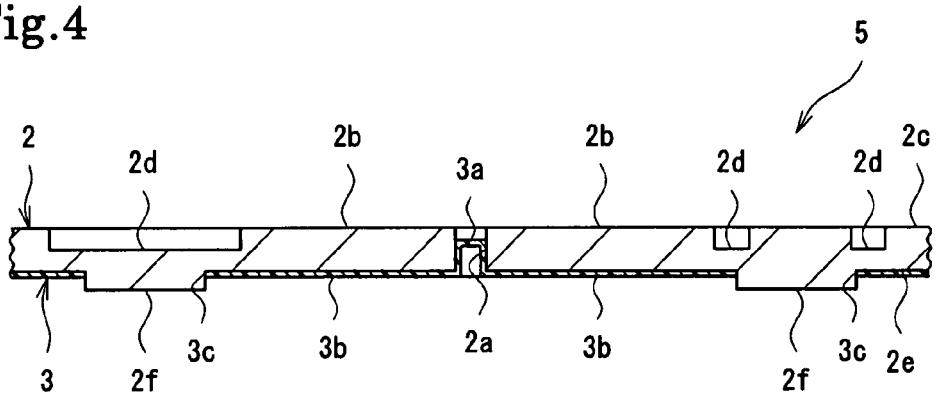
FIG. 4 is a sectional view, corresponding to region R of FIG. 2, of a second modification of the key sheet of the first embodiment.

Second Modification of the First Embodiment (FIG. 4): FIG. 4 shows a key sheet (5) according to a second modification of the first embodiment. In the key sheet (5) of the second modification, the tips of the protrusions (3*a*) are somewhat recessed from the front surface (2*c*). In this case, as in the first modification, no force in the shearing direction is applied to the protrusions (3*a*) by fingertips or the like, making it possible to prevent deformation of the protrusions (3*a*) by fingertips or the like. Further, the recesses of the dividing grooves (2*a*) are formed relatively small, so it is possible to easily identify the regions of the depressing operation members (2*b*) by the touch of fingertips, thereby not only preventing erroneous input but also making nails and fingertips less likely to be caught as compared with the case in which there are no protrusions (3*a*).

Figure 5:
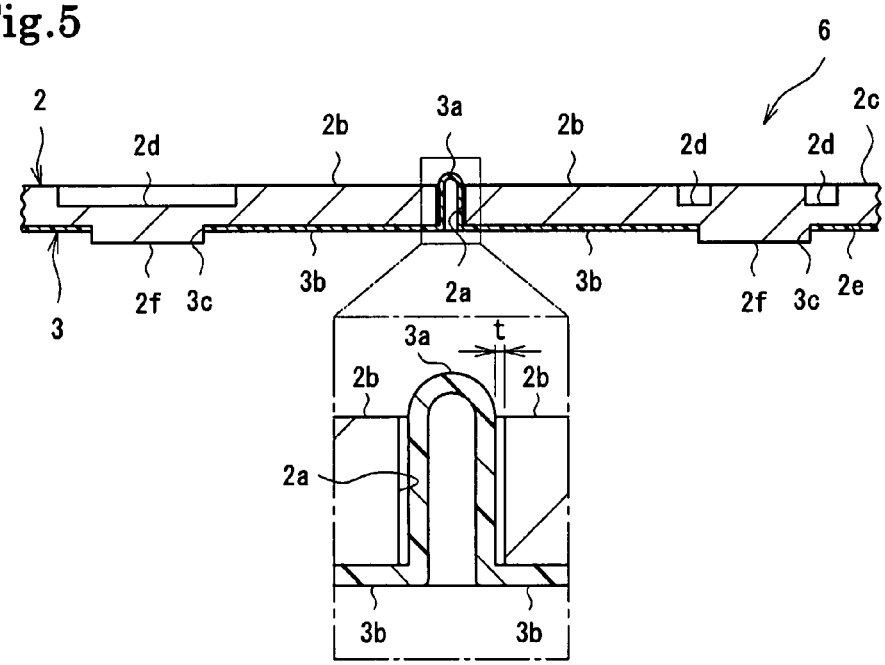
FIG. 5 is a sectional view, corresponding to region R of FIG. 2, of a key sheet according to a second embodiment of the present invention.

Second Embodiment (FIG. 5): FIG. 5 shows a key sheet (6) according to a second embodiment. The key sheet (6) of the second embodiment differs from the key sheet (1) of the first embodiment in that gaps (t) are formed between the protrusions (3*a*) provided in the film sheet (3) of the key sheet (6) and the side surfaces of the dividing grooves (2*a*) provided in the operation plate (2).

As in the first embodiment, in producing the key sheet (6) of the second embodiment, the operation plate (2) is formed by injection molding, and an adhesive layer is applied to the back surface (2*e*). Then, the operation plate (2) is inserted in the mold for molding the film sheet (3), which mold is provided with ribs for forming the gaps (t). As in the first embodiment, the mold is closed with the film sheet (3) placed, and heating emboss molding is performed on the film sheet (3); then, the outer edge of the film sheet (3) is cut off, whereby the key sheet (6) is obtained.

In the key sheet (6), the protrusions (3*a*) and the depressing operation members (2*b*) are spaced apart from each other by the gaps (t), so when the depressing operation members (2*b*) are depressed, the portions of the film sheet (3) corresponding to the gaps (t) are easily bent, thus diminishing the deformation of the depressing operation members (2*b*).

Figure 6:
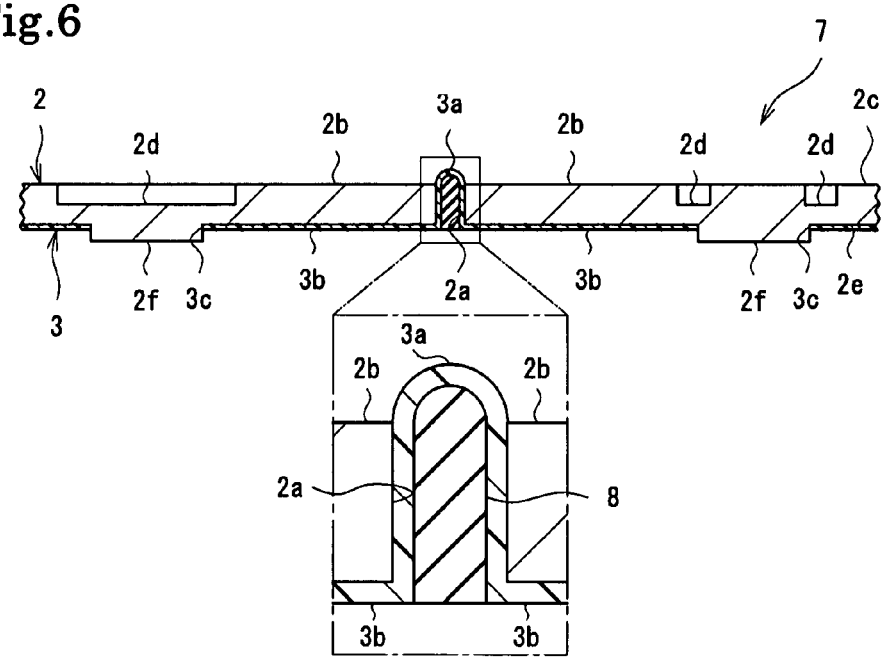
FIG. 6 is a sectional view, corresponding to region R of FIG. 2, of a key sheet according to a third embodiment of the present invention.

Third Embodiment (FIG. 6): FIG. 6 shows a key sheet (7) according to a third embodiment. The key sheet (7) of the third embodiment differs from the key sheet (1) of the first embodiment in the inner structure of the protrusions (3*a*).

In the key sheet (7), the spaces in the film sheet (3) formed by the protrusions (3*a*) are filled by solid portions (8) made of a rubber-like elastic material.

It is desirable for the rubber-like elastic material forming the solid portions (8) to be a thermosetting elastomer or a thermoplastic elastomer of high resiliency. Examples of such elastomer include a silicone rubber, an isoprene rubber, an ethylene propylene rubber, a butadiene rubber, a chloroprene rubber, a natural rubber, a styrene type thermoplastic elastomer, an ester type thermoplastic elastomer, a urethane type thermoplastic elastomer, an olefin type thermoplastic elastomer, an amide type thermoplastic elastomer, a butadiene type thermoplastic elastomer, an ethylene-vinyl-acetate type thermoplastic elastomer, a fluorine type thermoplastic elastomer, an isoprene type thermoplastic elastomer, and a chlorinated-polyethylene type thermoplastic elastomer. Further, of those rubber-like elastic materials, the silicone rubber is preferable in view of its low temperature dependence; from the viewpoint of durability, the styrene type thermoplastic elastomer and the ester type thermoplastic elastomer are preferable.

The film sheet (3) of this embodiment may be a film which is of low shape maintaining property or which is totally devoid of firmness. This is because the rubber-like elastic material forming the solid portions (8) can maintain the shape of the protrusions (3*a*).

As in the first embodiment, in producing the key sheet (7) of the third embodiment, the operation plate (2) is formed by injection molding, and an adhesive layer is applied to the back surface (2*e*). Then, after inserting the operation plate (2) in the mold for molding the film sheet (3), the film sheet (3) is placed and the mold is closed; then, heating emboss molding is performed on the film sheet (3) to thereby integrate the operation plate (2) and the film sheet (3) with each other. After that, the outer edge of the film sheet (3) is cut off. Finally, the operation plate (2) is inserted into the mold for molding the solid portions (8) such that the front surface (2*c*) of the operation plate (2) is held in contact with the mold surface, and then the mold is closed before pouring the rubber-like elastic material into the spaces in the protrusions (3*a*) by a pin gate to thereby mold the solid portions (8). In this way, the key sheet (7) can be obtained. While in this embodiment the protrusions (3*a*) are first formed in the film sheet (3) and then the rubber-like elastic material is poured into the spaces in the protrusions (3*a*) to form the solid portions (8), it is also possible to form the protrusions (3*a*) and the solid portions (8) simultaneously with the pouring of the rubber-like elastic material without previously forming the protrusions (3*a*).

In the key sheet (7), the protrusions (3*a*) are formed such that the film sheet (3) covers the solid portions (8) formed of the rubber-like elastic material, so the solid portions (8) formed of the rubber-like elastic material do not easily suffer separation or severance. Further, since the interiors of the protrusions (3*a*) are solid, if the protrusions (3*a*) are depressed with fingertips or the like at the time of depressing operation, the solid portions (8) resist from within to make it possible to prevent the protrusions (3*a*) from being dented. It is also possible to prevent the protrusions (3*a*) from being dented by providing the solid portions (8) such that they only partially occupy the tip portions of the protrusions (3*a*), without completely filling the protrusions (3*a*).

Figure 7:
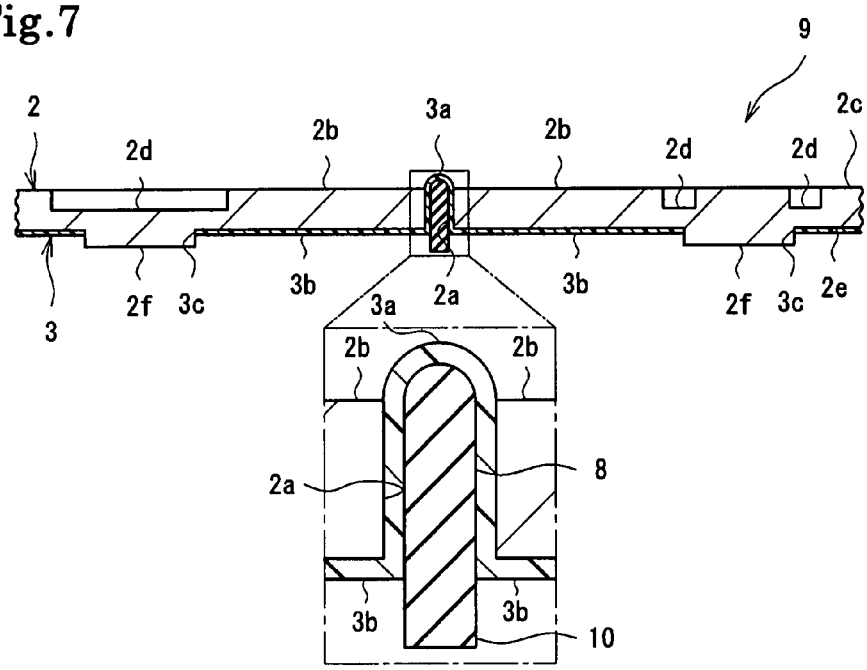
FIG. 7 is a sectional view, corresponding to region R of FIG. 2, of a modification of the key sheet of the third embodiment.

Modification of the Third Embodiment (FIG. 7): FIG. 7 shows a key sheet (9) according to a modification of the third embodiment. While in the key sheet (7) of the third embodiment the solid portions (8) are provided within the spaces defined by the protrusions (3*a*), in the key sheet (9) of the modification, it is possible for the solid portions (8) to protrude from the film sheet (3) in the same direction in which the pusher portions (2f protrude toward the board (not shown). This makes it possible for the protruding portions of the solid portions (8) to be brought into contact with the board surface as leg portions (10) of the key sheet (9). Thus, at the time of depressing operation, the leg portions (10) abutting the board surface prevent movement of the adjacent depressing operation members (2*b*) in operational connection, thereby preventing erroneous input.

Figure 8:
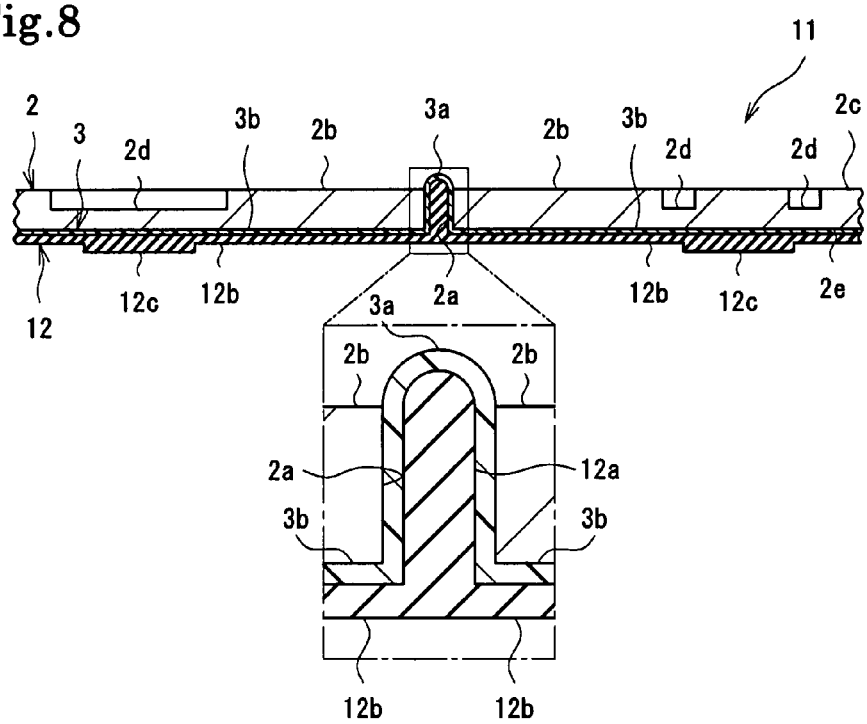
FIG. 8 is a sectional view, corresponding to region R of FIG. 2, of a key sheet according to a fourth embodiment of the present invention.

Fourth Embodiment (FIG. 8): FIG. 8 shows a key sheet (11) according to a fourth embodiment. The key sheet (11) of the fourth embodiment has a base sheet (12) on the back surface of the film sheet (3).

The base sheet (12) is made of a thin rubber-like member, and may be formed of the same material as the solid portions (8) of the key sheet (7) of the third embodiment. The base sheet (12) is fixed to the back surface of the film sheet (3) on the side opposite to the surface thereof opposed to the operation plate (2). The base sheet (12) is composed of protrusions (12*a*), a base portion (12*b*), and pusher portions (12*c*). Of those, the protrusions (12*a*) fill the interiors of the protrusions (3*a*) of the film sheet (3) as the "solid portions". The base portion (12*b*) is a portion integrally connecting a plurality of protrusions (12*a*), and is provided with the pusher portions (12*c*) for depressing contact switches (not shown) for each depressing operation member (2*b*).

The back surface (2*e*) of the operation plate (2) is a flat surface and devoid of no pusher portions (2*f*) as provided in the above-mentioned embodiments. Further, the film sheet (3) has no through-holes (3*c*) as formed in the above-mentioned embodiments.

As in the third embodiment, in producing the key sheet (11) of the fourth embodiment, the operation plate (2) is first formed by injection molding. Then, instant adhesive, ultraviolet curing adhesive or the like is applied to the back surface (2*e*) of the operation plate (2), and then the film sheet (3) is placed thereon to integrate it with the operation plate (2) through adhesion. After that, the outer edge of the film sheet (3) is cut off. Finally, the operation sheet (2) is inserted into the mold for molding the base sheet (12) such that the surface (2*c*) of the operation plate (2) is held in contact with the mold surface; then, the rubber-like elastic member is placed on the film sheet (3) and the mold is closed to form the base sheet (12) by compression molding. At this time, the protrusions (3*a*) are formed on the film sheet (3) under the pressure of the rubber-like elastic member, and at the same time, the solid portions (8) are formed in the protrusions (3*a*). In this way, the key sheet (11) is obtained.

In the key sheet (11), there is provided the base sheet (12) having the protrusions (12*a*), so there is no need to form the "solid portion" for each protrusion (3*a*) of the film sheet (3). Thus, the key sheet is easy to manufacture, and the integration with the film sheet (3) is facilitated.

Figure 9:
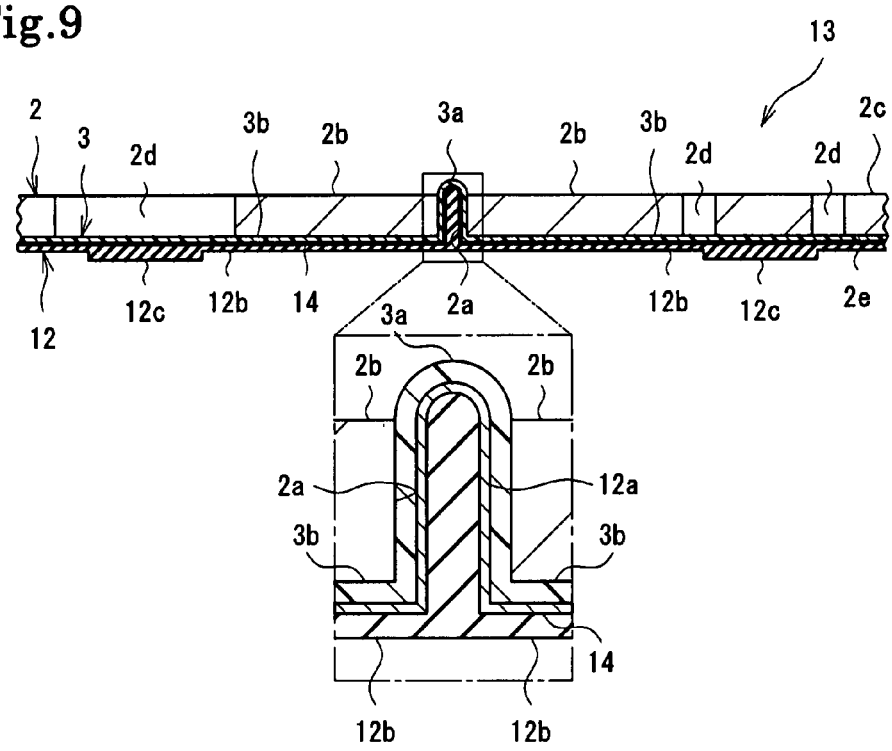
FIG. 9 is a sectional view, corresponding to region R of FIG. 2, of a first modification of the key sheet of the fourth embodiment.

First Modification of the Fourth Embodiment (FIG. 9): FIG. 9 shows a key sheet (13) according to a first modification of the fourth embodiment. While in the key sheet (11) of the fourth embodiment the display portions (2*d*) of the depressing operation portions (2*b*) are formed as bottomed recesses, in the key sheet (13) of the first modification, the display portions (2*d*) are formed as through-holes, and an EL layer (14) is provided on the entire back surface of the film sheet (3). In this case, when the EL layer (14) is caused to emit light, the display portions (2*d*) and the dividing grooves (2*a*) are illuminated, thus realizing an operation plate (2) easy to see even in a dark place. When the EL layer (14) is provided solely on the back side of the depressing operation members (2*b*), and is not provided in the dividing grooves (2*a*), it is possible to realize an operation plate (2) in which solely the display portions (2*d*) are illuminated; further, it is also possible to vary the color of the illumination light for each depressing operation member (2*b*), and to cause solely specific depressing operation members (2*b*) to emit light, thus additionally providing a guide function. The EL layer (14) is formed by stacking together two electrodes, a light emitting layer, an insulating layer (dielectric layer), etc., and is adapted to emit light through application of an electric field.

Figure 10:
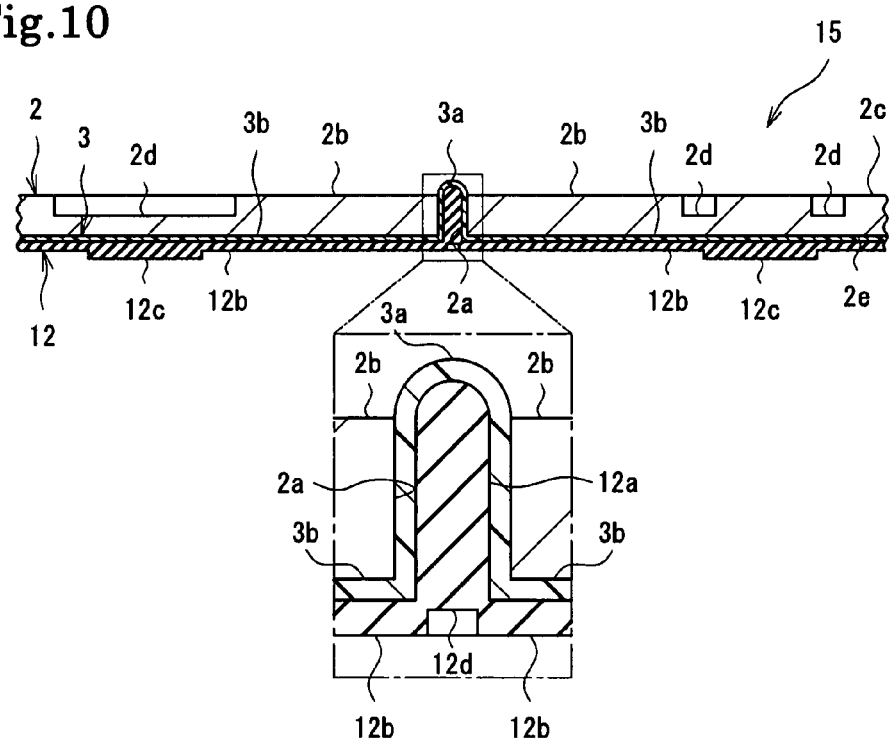
FIG. 10 is a sectional view, corresponding to region R of FIG. 2, of a second modification of the key sheet of the fourth embodiment.

Second Modification of the Fourth Embodiment (FIG. 10): FIG. 10 shows a key sheet (15) according to a second modification of the fourth embodiment. In the key sheet (15) of the second modification, recesses (12*d*) facing the board (not shown) are provided in the portions of the base portion (12*b*) of the base sheet (12) between the adjacent depressing operation members (2*b*). In this case, in the key sheet (15) of the second modification, thin-walled portions are formed in the portions of the base portion (12*b*) between the depressing operation members (2*b*), so the base portion (12*b*) can be easily deformed when the depressing operation members (2*b*) are depressed, thus making it possible to reduce the depression load of the depressing operation members (2*b*).

Modification of the First through Fourth Embodiments (FIG. 11): The key sheets (1, 4, 5, 6, 7, 9, 11, 13, 15) of the first through fourth embodiments and the modifications thereof further allow the following modifications.

Figure 11:
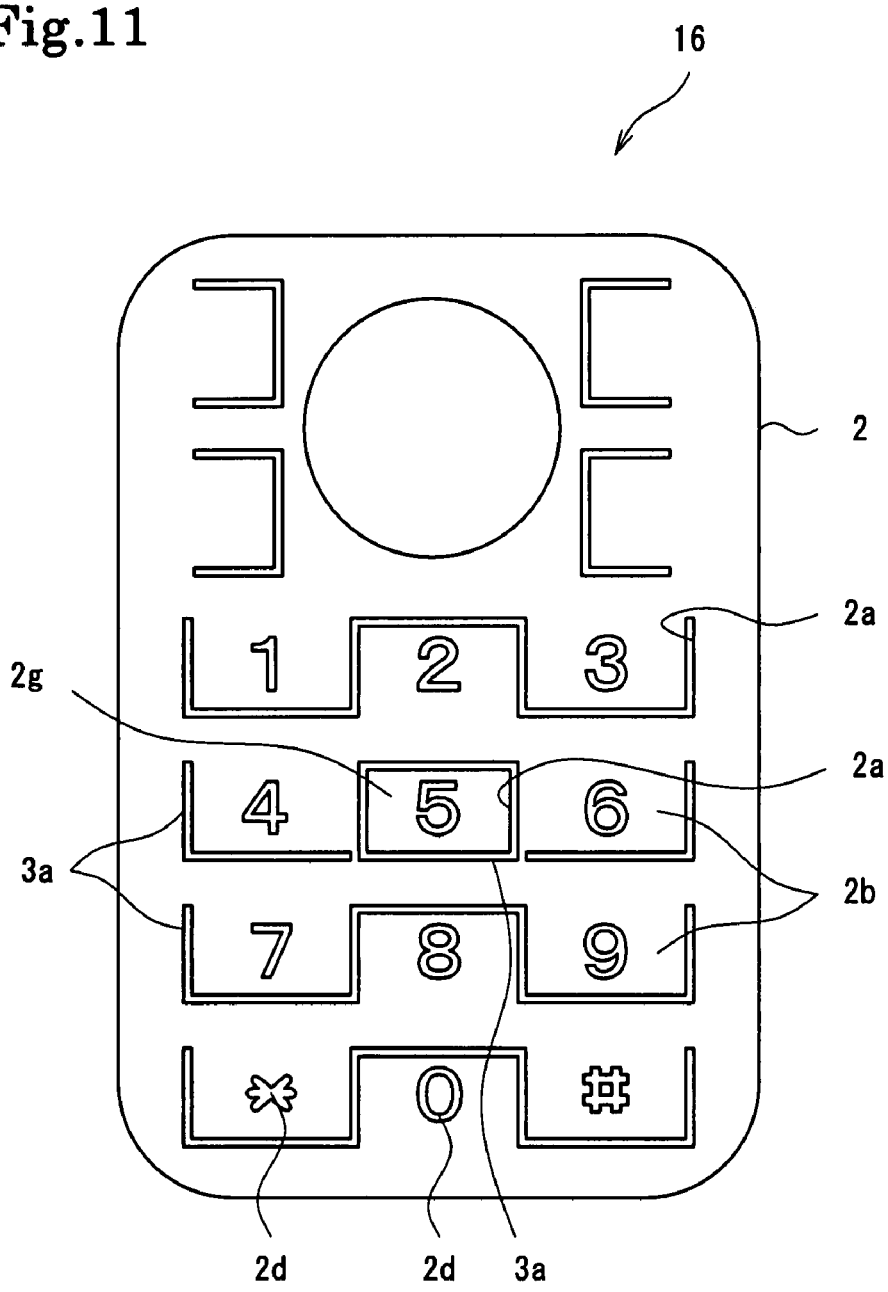
FIG. 11 is a plan view of a modification of the key sheets of the first through fourth embodiments.

In a key sheet (16) shown in FIG. 11, there is provided a loop-like dividing groove (2*a*), and the entire periphery of the corresponding depressing operation member (2*b*) is divided by a dividing groove (2*a*). The operation plate (2) has a loop-like dividing groove (2*a*), and is equipped with a division plate (2*g*) as a "divisional depressing operation member". More specifically, the depressing operation member provided with the display portion (2*d*) representing the number "5" constitutes the division plate (2*g*). The division plate (2*g*) is integrally connected with the operation plate (2) by a loop-like protrusion (3*a*) of the film sheet (3) provided in the loop-like dividing groove (2*a*).

Since it is equipped with the operation plate (2) and the division plate (2*g*), the key sheet (16) can realize a unique and novel design. Further, the load under which the protrusions (3*a*) of the film sheet (3) undergo deformation through depression is smaller than the load under which the plate portion of the operation plate (2) is bent through depression, so, as compared with the depressing operation member (2*b*) surrounded on three sides by the protrusion (3*a*), the division plate (2*g*) surrounded by the loop-like protrusion (3*a*) involves less depression load.

The features of each of the above-mentioned embodiments are applicable to other embodiments. For example, it is also possible to form the display portions (2*d*) of the first through third embodiments as through-holes and to provide the film sheet (3) with the EL layer (14). In another example, it is also possible to provide the solid portions (8) in the spaces of the protrusions (3*a*) of the second embodiment. In still another example, it is also possible to form the solid portions (8) of the third and fourth embodiments as columnar components and to arrange them in a dotted fashion at intervals in the surface direction of the operation plate (2).

While in the above-mentioned embodiments the dividing grooves (2*a*) are formed in a square-wave-like configuration, they may also be formed in a round-wave-like configuration. Instead of forming them in a linear configuration, the edges of the dividing grooves (2*a*) may also be formed in a curved or an undulated configuration.

While in the above-mentioned embodiments the display portions (2*d*) are formed on the surface (2*c*) of the operation plate (2), it is also possible to form the operation plate (2) of a transparent material, and to provide the display portions (2*d*) on the back surface (2*e*) of the operation plate (2) in the form of recesses, print layers, etc.

Further, while in the above-mentioned embodiments the protrusions (3*a*) of the film sheet (3) are provided solely in the dividing grooves (2*a*) of the operation plate (2), it is also possible to form the display portions (2*d*) of the operation plate (2) as through-holes and to provide the protrusions (3*a*) of the film sheet (3) not only in the dividing grooves (2*a*) but also in the holes of the display portions (2*d*). This makes it possible to ascertain the positions of not only the dividing grooves (2*a*) but also the display portions (2*d*) by virtue of the protrusions (3*a*), making it possible to identify the regions of the depressing operation members (2*b*) and the configurations of the display portions (2*d*) by the touch. Thus, it is possible to prevent erroneous input.

Further, while in the above-mentioned embodiments the operation plate (2) is formed by injection molding, it is also possible to form a resin plate by extrusion molding, and to form the dividing grooves (2*a*) and the display portions (2*b*) in this resin plate by stamping and cutting to thereby produce the operation plate (2).

What is claimed is:

1. A key sheet, comprising:

an operation plate formed of a single plate provided with a dividing groove defining a depressing operation member capable of displacement through depression; and a film sheet made of a resin film provided on a back surface which is on the opposite side of an operating surface of the operation plate, wherein the film sheet having uniform thickness is provided with a deformable protrusion swelling from the back surface of the operation plate and extending into the dividing groove and beyond the operating surface of the operation plate.

2. A key sheet according to claim 1, wherein a gap is provided between the protrusion and a side surface of the dividing groove.

3. A key sheet according to claim 1, wherein a solid portion formed of an elastic material occupies the interior of the protrusion.

4. A key sheet according to claim 3, wherein the solid portion is provided with a protruding portion protruding outward from the film sheet in the opposite direction in which the protrusion protrude.

5. A key sheet according to claim 1, further comprising a base sheet provided on a back surface of the film sheet and formed of an elastic material.

6. A key sheet according to claim 5, wherein an EL layer is provided between the back surface of the film sheet and the base sheet.

7. A key sheet according to claim 5, wherein the base sheet has a recess between adjacent depressing operation members.

8. A key sheet according to claim 1, further comprising a depressing operation member defined by a closed-loop dividing groove.

9. A key sheet according to claim 1, wherein:

the operation plate is formed of a hard resin material selected from the group consisting of a polycarbonate resin, a polyester resin, an acrylic resin, and an ABS resin; and the film sheet is made of a resin film formed of a material selected from the group consisting of a polyolefin type resin, a polyester type resin, a polyurethane type resin, and a polyamide type resin.

10. A key sheet according to claim 1, wherein the protrusion has a hollow interior.

11. A key sheet according to claim 1, wherein the depressing operation member is formed with display portions representing characters, numbers, symbols, figures as through-holes, and the film sheet is provided with the protrusion swelling from the back surface of the operation plate extending into the dividing groove and also into the holes of the display portions.

12. A key sheet, comprising:

an operation plate formed of a single plate provided with a dividing groove defining a depressing operation member capable of displacement through depression; and a film sheet made of a resin film provided on a back surface which is on the opposite side of an operating surface of the operation plate, wherein the film sheet is provided with a deformable protrusion swelling from the back surface of the operation plate and extending into the dividing groove and beyond the operating surface of the operation plate, and wherein the operation plate further includes a pusher portion extending from the back surface and beyond the film sheet.

* * * * *